US005485253A

United States Patent [19]

Osbourne

[11] Patent Number: 5,485,253

[45] Date of Patent: Jan. 16, 1996

[54] CORONA GENERATING DEVICE HAVING REPLACEABLE SHIELD MEMBERS

[75] Inventor: William G. Osbourne, Webster, N.Y.

[73] Assignee: Xerox Corporation, Stamford, Conn.

[21] Appl. No.: 176,188

[22] Filed: Jan. 3, 1994

[51] Int. Cl.[6] ..... G03G 15/02

[52] U.S. Cl. ..... 355/221; 250/324; 361/225

[58] Field of Search ..... 355/219, 221, 355/222, 215; 361/225, 220, 212, 221, 222; 250/324–326; 430/902

[56] References Cited

U.S. PATENT DOCUMENTS

| | | | |
|---|---|---|---|
| 3,811,048 | 5/1974 | Matsumoto et al. | 250/326 |
| 4,258,258 | 3/1981 | Laing et al. | 250/324 |
| 4,585,320 | 4/1986 | Altavela et al. | 355/221 X |
| 4,585,322 | 4/1986 | Reale | 355/221 X |
| 4,585,323 | 4/1986 | Ewing et al. | 355/221 X |
| 5,245,386 | 9/1993 | Asano et al. | 355/219 |

FOREIGN PATENT DOCUMENTS

| | | | |
|---|---|---|---|
| 53-26138 | 3/1978 | Japan | 250/324 |
| 61-179468 | 8/1986 | Japan | 355/221 |
| 61-284778 | 12/1986 | Japan | 355/221 |
| 4-055870 | 2/1992 | Japan | 355/221 |

*Primary Examiner*—A. T. Grimley
*Assistant Examiner*—Shuk Y. Lee
*Attorney, Agent, or Firm*—Denis A. Robitaille

[57] ABSTRACT

A corona generating device including a housing for receiving a replaceable shield having a base shield element and a pair of side shield elements, wherein each of the shield elements are mounted in the housing in a configuration so as to partially enclose a corona generating electrode. The housing is provided with pivotable side panels which each further include a pair of lip elements forming a channel for slidably receiving a respective side shield element. The side panels are pivoted about a pivot axis for facilitating the service and replacement of the side shield elements to thereby prolong the operational life of the corona generating device.

20 Claims, 3 Drawing Sheets

CORONA GENERATING DEVICE HAVING REPLACEABLE SHIELD MEMBERS

The present invention relates to a corona generating device and, more particularly, is directed to a reusable corona charging apparatus for use in an electrostatographic printing machine to generate a flow of ions onto an adjacent imaging surface so as to alter the electrostatic charge thereon.

Generally, the process of electrostatographic copying is initiated by placing a substantially uniform electrostatic charge on a photoreceptive member. Subsequent to this charging step, an imaging process is carried out by exposing a light image of an original document onto the substantially uniformly charged photoreceptive member. Exposing the charged photoreceptive member to a light image discharges a photoconductive surface thereon in areas corresponding to non-image areas in the original document while maintaining the charge in image areas, thereby creating an electrostatic latent image of the original document on the photoreceptive member. This latent image is subsequently developed into a visible image by depositing charged developing material onto the photoreceptive member such that the developing material is attracted to the charged image areas on the photoconductive surface. Thereafter, the developing material is transferred from the photoreceptive member to a copy sheet or to some other image support substrate for creating an image which may be permanently affixed to the image support substrate, thereby providing a reproduction of the original document. In a final step in the process, the photoconductive surface of the photoreceptive member is cleaned to remove any residual developing material which may be remaining on the surface thereof in preparation for successive imaging cycles.

The electrostatographic copying process described hereinabove is well known and is commonly used for light lens copying of an original document. Analogous processes also exist in other electrostatographic printing applications such as, for example, digital laser printing where a latent image is formed on the photoconductive surface via a modulated laser beam, or ionographic printing and reproduction where charge is deposited on a charge retentive surface in response to electronically generated or stored images.

In addition to charging the imaging surface of a electrostatographic system prior to exposure, corona devices are used to perform a variety of other functions in the electrostatographic process. For example, corona generating devices aid in: the transfer of an electrostatic toner image from a reusable photoconductive imaging member to a transfer member such as paper; the tacking and detacking of the transfer member to and from the imaging member; and the conditioning of the surface of the imaging member prior to, during, and after deposition of toner thereon to improve the quality of the electrostatographic copy produced thereby. Each of these functions are carried out by a separate and independent corona generating device. The relatively large number of devices within a single machine necessitates the economical use of corona generating devices.

Various types of charging devices have been used to charge or precharge the surface of a photoconductive member. In commercial use, for example, corona generating devices are used extensively, wherein a voltage of 2,000 to 10,000 volts may be applied across an electrode to produce a corona spray which imparts electrostatic charge to a surface situated in close proximity thereto. One particular corona generating device includes a single corona generating electrode strung between insulating end blocks mounted on either end of a channel formed by a U-shaped shield or a pair of spaced side shield members. The corona generating electrode is typically highly conductive, elongated wire positioned opposite the surface to be charged. In other conventional corona generating devices, the corona generating electrode may also be in the form of a pin array. Another device, frequently used to provide more uniform charging and to prevent overcharging, includes two or more corona generating electrodes with a control grid comprising a screen having a plurality of parallel wires or a plate having multiple apertures positioned between the corona generating electrodes and the photoconductive member. In this device, a potential having the same polarity as that applied to the corona electrodes but having a much smaller voltage magnitude, usually on the order of a few hundred volts, is applied to the control grid to suppress the electric field between the control grid and the corona electrodes, markedly reducing the ion current flow to the photoconductive member.

Yet another type of corona generating device is described in U.S. Pat. No. 4,086,650 to Davis et al, wherein a corona discharge electrode is coated with a relatively thick dielectric material such as glass for substantially preventing the flow of conduction current therethrough. In this device, the delivery of charge to the photoconductive member is accomplished by a displacement current or by capacitive coupling through the dielectric material. The flow of ions to the surface to be charged is regulated by means of a DC bias applied to the shield of the corona generating device. In operation, an AC potential of approximately 5,000 to 7,000 volts is applied to the coated electrode at a frequency of about 4 KHz to produce an actual corona generating current of approximately 1 to 2 milliamps. This device has the advantage of providing a uniform charge to the photoconductive member using a charge generating device that is highly insensitive to contamination by dirt and therefore does not require repetitive cleaning or other maintenance requirements.

One problem associated with corona generating devices occurs in the presence of the generated corona, wherein a region of high chemical reactivity is also produced such that new chemical compounds are synthesized in the machine air. This chemical reactivity correspondingly causes a build up of chemical growth on the corona generating electrode as well as other surfaces adjacent thereto. After a prolonged period of operation, these chemical growths not only degrade the performance of the corona generating device but also the entire electrostatographic machine.

It has been found that free oxygen and ozone are produced in the corona region, as well as other so called "corona effluents" such as nitrogen oxide, and nitrogen oxide species, among others. These nitrogen oxide species react with solid surfaces. In particular, it has been observed that these nitrogen oxide species are adsorbed by the conductive control grid, the shield, shield members and other components of the corona generating device. The adsorption of nitrogen oxide species occurs despite the fact that the corona generating device may be provided with a directed air flow during operation for removing the nitrogen oxide species as well as controlling ozone emissions. In fact, during the process of collecting ozone, directed air flow may exacerbate problems by carrying the nitrogen oxide species to an affected area of the corona generating device or even to some other machine part.

The reaction of corona generating process byproducts, such as nitrogen oxide, with the shield, the control grid, or other corona generating device components can result in corrosive buildup and deposition on the surfaces thereof. These deposits can cause problems such as nonuniform photoreceptor charging, manifested by side-to-side density variations or dark and light streaks in tan output copy. Also, depending on environmental conditions, deposits may charge up and effectively increase the shield or screen voltage, resulting in similar nonuniformity defects. Extreme cases of corrosion can lead to arcing between the corona generating electrode and the screen on the shield members.

Another problem associated with corona generating devices operating in a electrostatographic environment results from toner accumulation ion the surface of the corona generating electrode as well as surfaces adjacent thereto. The spots of accumulated toner, being a dielectric in nature tend to cause localized charge buildup on the interior surfaces of that shield which produces current nonuniformity and reduction in corona current. Localized toner accumulations on the insulating end blocks which support the wire electrode also cause sparking.

It has also been found that adsorption can be a physically reversible process such that the adsorbed nitrogen oxide species are gradually desorbed when a machine is turned off for an extended period of idleness. It should be understood that the adsorbed and desorbed species are both nitrogenous but not necessarily the same, i.e., there may be conversion of $NO_2$ to $HNO_3$. When the operation of the machine is resumed, a copy quality defect, commonly called a parking deletion, is observed wherein a line image deletion or a lower density image is formed across the width of the photoreceptor at that portion of its surface resting opposite the corona generating device during the period of idleness. It is believed that the nitrogen oxide species in some way interact with the surface of the photoreceptor to increase the lateral conductivity thereof such that the photoreceptor cannot retain a charge in image configuration. This phenomenon basically causes narrow line images to blur or to wash out so as to not be developed as a toner image.

In corona generating devices, it has been found that the material from which the components, such as the shield or control grid, are fabricated has a significant effect on the severity of parking deletions. In the prior art, stainless steel materials have commonly been used. Other materials, such as corrosion resistant ferris materials which prevent the rapid oxidation of the component material and the concurrent loss of performance of the corona generator, have met with limited success, primarily due to the corrosive effect of the corona produced by the device.

In other attempts to reduce the problems associated with corona charging, considerable work has been done to reduce the adsorption of nitrogen oxides species by device components via the application of so called electrodag coatings to the surfaces thereof. Such coatings typically include a reactive metal base such as nickel, lead, copper, zinc or mixtures thereof. These reactive metal base materials tend to absorb, or form harmless compounds with, the nitrogen oxide species. Electrodag materials have also had limited success in addressing the problem of parking deletions. However, parking deletion problems have continued due to the failure of the electrodag materials to continue to absorb or form harmless compounds with the nitrogen oxide species over time. In addition, certain components are somewhat expensive to fabricate.

Thus, to date, the problem of chemical growth build-up in and around corona generating devices has been addressed by providing coating materials that are less prone to chemical attack. While adequately addressing the problem, such materials have substantially increased the cost of corona generating devices. Various forms of corona generating devices have been described for use in electrostatographic reproduction machines. The following disclosures may be relevant to various aspects of the present invention:

U.S. Pat. No. A 4,258,258
Patentee: Laing et al.
Issued: Mar. 24, 1981

U.S. Pat. No. A 4,585,320
Patentee: Altavela et al.
Issued: Apr. 29, 1986

U.S. Pat. No. 4,585,322
Patentee: Reale
Issued: Apr. 29, 1986

U.S. Pat. No. A 4,585,323
Patentee: Ewing et al.
Issued: Apr. 29, 1986

The relevant portions of the foregoing disclosures may be briefly summarized as follows:

U.S. Pat. No. A 4,258,258 discloses a corona generating device having a corona generating electrode supported between a pair of end block assemblies. Each end block assembly defines a space for the passage of the electrode, and nonconductive inserts for surrounding the electrodes that are seated in the spaces of the end block assemblies. The nonconductive inserts are made from a high dielectric strength material that is also resistant to a corrosive atmosphere. The inserts are easily and inexpensively replaced so as to protect the end block assemblies from the effects of high voltage applied to the corona electrode.

U.S. Pat. No. A 4,585,320 discloses a corona generating device for depositing negative charge on an imaging surface carried on a conductive substrate comprising at least one elongated conductive corona discharge electrode, means to connect the electrode to a corona generating potential source, at least one element adjacent the corona discharge electrode capable of adsorbing nitrogen oxide species once the corona generating electrode is energized and capable of desorbing nitrogen oxide species once that electrode is not energized, the element being plated with a substantially continuous layer of lead to neutralize the nitrogen oxide species when generated. In a preferred embodiment the corona discharge electrode comprises a thin wire coated at least in the discharge area with a dielectric material and at least one element comprising a conductive shield and an insulating housing having two adjacent sides to define the longitudinal opening to permit ions from the electrode to be directed towards a surface to be charged, both the shield and the two sides of the housing being plated with a continuous thin layer of lead.

U.S. Pat. No. A 4,585,322 discloses a corona generating device similar to that discussed in previously referenced and described U.S. Pat. No. A 4,505,320, wherein the element adjacent the corona discharge electrode capable of adsorbing nitrogen oxide species once the corona generating electrode is energized and capable of desorbing nitrogen oxide species once that electrode is not energized is coated with a substantially continuous thin dehydrated alkaline film of an alkali silicate to neutralize the nitrogen oxide species when generated.

U.S. Pat. No. A 4,585,323 discloses a corona generating device similar to that described in above referenced and described U.S. Pat. No. A 4,585,320 and U.S. Pat. No. A 4,585,322, wherein the element adjacent the corona discharge electrode capable of adsorbing nitrogen oxide species once the corona generating electrode is energized and capable of desorbing nitrogen oxide species once that electrode is not energized is coated with a substantially continuous thin layer of a paint containing reactive metal particles which will combine with the nitrogen oxide species, the reactive metal being present in the paint in an amount sufficient to neutralize the nitrogen oxide species when generated. Preferably the reactive metal particles comprise lead, copper, nickel, gold, silver or zinc or mixtures thereof.

Notwithstanding the results obtained by employing a corona generating device according to the aforementioned patents, problems associated with degradation of the corona generating electrode and contamination of the shield and other components still require that the corona generating device be periodically cleaned and, if necessary, replaced. However, the process of replacing a corona generating device is an expensive and time consuming process, requiring the skills of a trained technician. Normally, the worn wire is removed from the corona device and replaced by a new wire. Alternatively, the entire unit is removed, with the shield being cleaned with an abrasive material to remove dirt and toner accumulations. More frequently, however, the entire corona generating device is treated as a disposable assembly, whereby the entire device is removed and replaced by a new device. This practice is costly and wasteful.

It would, therefore, be more desirable to facilitate the replacement of contaminated components making up a corona generating device in electrophotographic machines.

In accordance with one aspect of the present invention, a corona generating device for depositing an electrostatic charge on a surface is disclosed. The corona generating device comprises a housing, an elongated electrode adapted to generate a corona, supported by the housing and opposed side panels movably mounted on the housing, defining an open face in the housing for exposing the elongated electrode to the surface to be charged. In addition, means for pivotably mounting the opposed side panels on the housing to provide access to the interior surface thereof are also provided.

In accordance with another aspect of the present invention, an electrostatographic printing apparatus, including a corona generating device for depositing an electrostatic charge on a surface situated in close proximity thereto is provided. The corona generating device comprises a housing, an elongated electrode adapted to generate a corona, supported by the housing and opposed side panels movably mounted on the housing, defining an open face in the housing for exposing the elongated electrode to the surface to be charged. In addition, means for pivotably mounting the opposed side panels on the housing to provide access to the interior surface thereof are also provided.

These and other aspects of the present invention will become apparent from the following description in conjunction with the accompanying drawings, in which.

As indicated hereinabove, the present invention provides a novel corona generating device for use in an electrostatographic printing machine. One of skill in the art will recognize that the corona generating device of the present invention has more than one possible use in an electrostatographic processing system. It will be understood that, although the present invention will be described in the context of a charging system, this invention may also be incorporated into other electrostatographic machine subsystems, such as, for example, but not limited to, the transfer system of a typical electrostatographic apparatus. While the present invention will be described with reference a preferred embodiment thereof, it will be understood that the invention is not to be limited to this preferred embodiment. On the contrary, it is intended that the present disclosure cover all alternatives, modifications, and equivalents as may be included within the spirit and scope of the invention as defined by the appended claims. Other aspects and features of the present invention will become apparent as the description proceeds.

Figure 5:
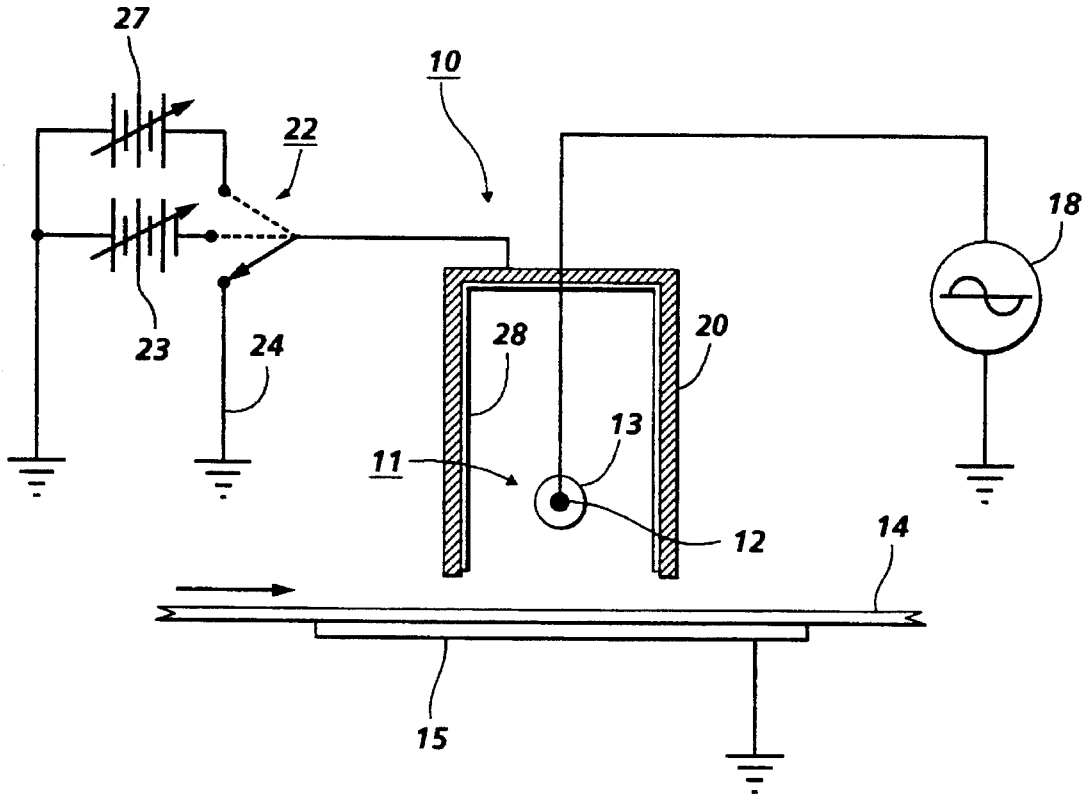
FIG. 5 PRIOR ART
FIG. 5 is an illustrative cross sectional view of a prior art corona generating device.

Referring initially to FIG. 5 prior to describing the particular features of the present invention, an exemplary prior art corona generating device 10 having a corona generating electrode 11, is shown. For illustrative purposes, the corona generating electrode 11 is in the form of a conductive wire 12 having a relatively thick coating 13 of dielectric material. Corona generating devices incorporating this type of electrode are generally known in the art as "dicorotrons". It will be understood that the electrode 11 might take the alternative form of a pin array, a thin wire, or a plurality of pin arrays or thin wires, comprised of any material or configured in any manner as may be known in the art. As such, the Figures and description of the present invention, as provided herein, are provided for the purpose of illustrating an exemplary embodiment of the present invention and are not intended to limit the same.

A charge collecting surface 14, is shown which may be a photoconductive surface in a conventional electrostatographic system, is situated in close proximity to the corona generating device, as shown. The charge collecting surface 14 is carried on a conductive substrate 15 held at a reference potential that is usually machine ground. An AC voltage source 18 is connected between the substrate and the corona wire 12. The frequency of the AC source 18 may be varied widely in the range from 60 hertz (the frequency of electric power supply in the United States) to several megahertz. The device normally operates satisfactorily at a frequency of 4 KHz.

A conductive shield member 20 is located adjacent the corona generating electrode 11, substantially enclosing the electrode on all sides except the side opposite the chargeable surface 14. The shield member 20 is connected to a switch 22 which, depending upon its position, permits the corona generating device to be operated in either a charge neutralizing mode or a charge deposition mode. With the switch 22 positioned as shown, the shield of the corona device is coupled to ground via a lead 24. In this position, no DC field is generated between the surface 14 and the shield 20 such that, the corona generating device operates to neutralize any charge present on the surface 14. Alternatively, with switch 22 in either of the positions shown by dotted lines, the shield member 20 is connected to a DC source 23 or 27, so as to apply a biasing voltage to the shield member 20 for establishing a DC field between the surface 14 and the shield 20. In this position, the corona generating device 10 operates to deposit a net charge onto the surface 14, the polarity and magnitude of which is dependent upon the polarity and magnitude of the DC bias applied to the shield 20.

The shield is shown as being substantially rectangularly U-shaped, but any of the conventional shapes used for corona shields in electrostatographic charging may be employed. In fact, the function of the shield 20 may be performed by any conductive member, for example, a base wire, in the vicinity of the discharge electrode 11, the precise location not being critical to obtain satisfactory operation of the device.

The corona generating electrode 11 may be supported in a conventional fashion at the ends of the corona generator 10 by insulating end blocks (not shown) mounted within the ends of the shield structure 20. The conductive wire 12 may be made of any conventional conductive filament material such as stainless steel, gold, aluminum, copper, tungsten, platinum or the like. The diameter of the wire is not critical and may vary typically between 0.5–15 mils and is preferably about 9 mils.

Any suitable dielectric material may be employed as the coating 13 which will not breakdown under the applied corona AC voltage, and which will withstand chemical attack under the the conditions present in a corona device. The thickness of the dielectric coating 13 used in the corona device is such that substantially no conduction current or DC charging current is permitted therethrough. Typically, the thickness is such that the combined wire and dielectric thickness is in the range of from 7–30 mils, with a typical dielectric thickness being approximately 2–10 mils. Glasses with a dielectric breakdown strength above 2 KV/mil at 4 KHz. and in the range of 2 to 5 mil thickness have been found to perform satisfactorily as the dielectric coating material.

During a typical charging operation, an AC voltage is applied to the corona generating electrode 11. The magnitude of the AC voltage is generally in the range of 4 KV to 7 KV, having an applied frequency between 1 Khz to 10 Khz. With the conductive substrate of the imaging member at ground potential, a negative DC bias of from about 800 volts to about 4 KV is applied to the shield. For further details of the manner of operation of the above described dicorotron device, attention is directed to U.S. Pat. No. 4,086,650 to Davis et al., which is hereby incorporated in its entirety into the instant disclosure.

With continued reference to FIG. 5, the shield 20 is coated with a substantially continuous thin film 28, containing a sufficient amount of reactive particles that will combine with nitrogen oxide species and/or other corona effluents which may be produced by the corona for neutralizing the same. Various reactive particles have been used for the thin film coating 28 as applied to the shield 20. Attention is directed to U.S. Pat. No. 4,585,320 to Altavela et al which describes a thin layer of lead. U.S. Pat. No. 4,585,322 to Reale discloses the shield being coated with a continuous thin dehydrated alkaline film of an alkali silicate to neutralize the nitrogen oxide species when generated. U.S. Pat. No. 4,585,323 to Ewing et al teaches the use of a thin layer of paint containing reactive metal particles comprising lead, copper, nickel, gold, silver, zinc, or mixtures thereof. Other particular materials have been disclosed in U.S. Pat. Nos. 4,646,196, 4,792,680, and 4,920,266, among others. All these patents referred to are are hereby incorporated by reference in their entirety into the present disclosure. The exact mechanism by which the coated base metal shield containing the reactive particles neutralizes the corona effluents species is not fully understood. In the case of chemical reactants such as nitrogen oxide, it is believed that the reactive particles in the film combine with the nitrogen oxide to form metal nitrates in an irreversible reaction to completely remove the possibility of exposure with the photoreceptor to the nitrogen oxide species. It is further believed that the nitrogen oxide species penetrate the thin film and are neutralized by the metal in the thin film 28. Lead nitrate is only one of the metals recited and known in the art to form a non-deliquescent nitrate salt. The other metal nitrates are protected from moisture by the thin film layer.

To insure that the corona effluents are not adsorbed and subsequently desorbed by the shield, the thin film layer 28 should be in the form of a substantially continuous layer without pores. Furthermore, in order to insure the irreversible neutralization of the nitrogen oxides, the thin film layer 28 should be sufficiently thick so that the reactive particles within it will not be consumed in unreasonable periods of time, thereby limiting the operational life of the device.

The numerous thin film coatings described above may be obtained by various methods. In the past, the plating layer has been formed through electroplating or vacuum deposition directly onto the shield of the corona generating device. Alternatively, a method similar to spray painting has been employed to deposit the coating layer onto the shield of a corona generating device. In another alternative, as pointed out in U.S. Pat. No. 4,585,320 to Altavela et al., it is suggested that the plating may be applied directly to relatively thin strip inserts. The present invention is directed to providing replaceable shield members which may have a coating thereon, wherein the shield members can be easily mounted within a housing in the form of a substantially rectangular, U-shaped shield. In-field replacement of these shield members is contemplated for providing means for servicing the corona generating device to prolong the operational life thereof.

Figure 1:
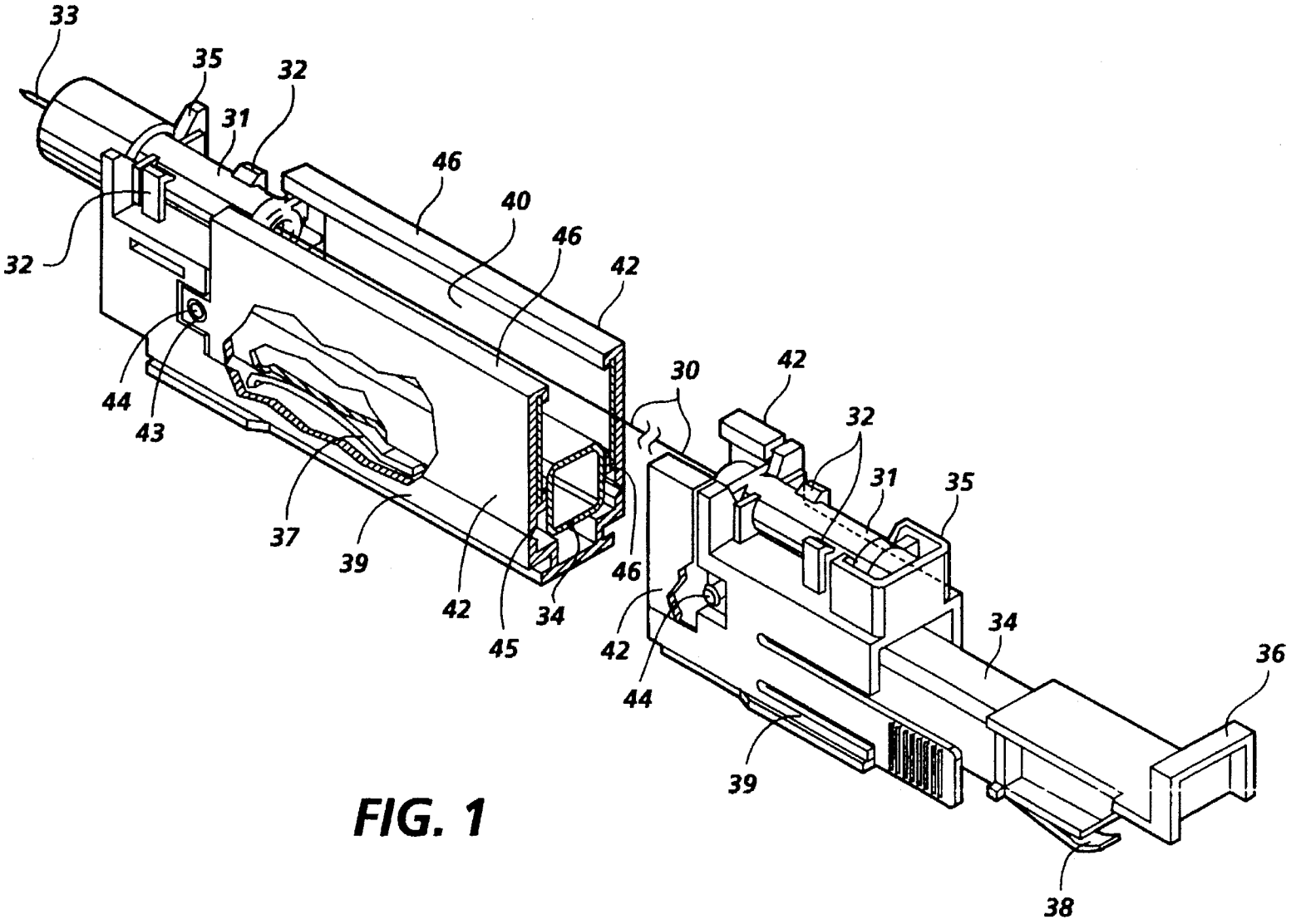
FIG. 1 is an perspective view of a preferred embodiment of a corona generating device according to the present invention.

FIG. 1 illustrates a preferred embodiment of a corona generating device in accordance with the present invention. In FIG. 1, an elongated corona generating electrode 30 is supported within an elongated housing, generally identified by reference numeral 50, which may be made from a single molding of any suitable material such as glass filled polycarbonate. The housing 50 is characterized by a generally rectangular body including a base 39 and a pair of side panels 42 extending along the length of the housing, defining an open face structure for exposing the electrode to the surface to be charged. End blocks 35 are located at opposite ends of the elongated housing 50 for supporting the corona generating electrode 30 at opposite ends thereof. Each end block 35 are includes a pair of spaced resilient finger elements 32 for receiving cylindrical mounting anchors 31 situated at opposite ends of the electrode 30. Mounting anchors 31 are provided for facilitating handling of the electrode as well as for protecting the end blocks 35 from the effects of high voltage applied to the corona generating electrode. At least one of the mounting anchors 31 includes a high voltage contact pin 33 for providing the necessary coupling contact to an AC power supply to apply a biasing voltage to the corona generating electrode 30.

Figure 2:
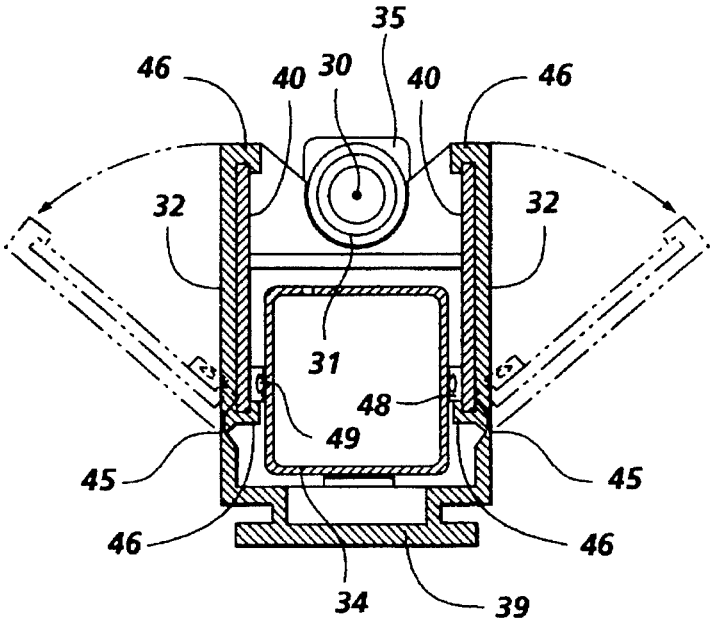
FIG. 2 is a cross-sectional elevational view of the the preferred embodiment shown in FIG. 1.

In accordance with the present invention, side panels 42 are advantageously made to be pivotable for providing access to the interior surface thereof, as illustrated in FIG. 1, wherein the same numerals used in FIG. 2 have been employed to identify the same elements in a cross-sectional view of the preferred embodiment. In order to facilitate this pivotable feature, a pivot axis 45 is provided for permitting each side panel 42 to be manipulated thereabout. The pivot axis 45 can be provided by means of an actual hinge element, similar in nature to a common piano hinge, or, in a preferred embodiment, can be provided by means of a so called "living hinge", defined by a joint or a seam integrally formed in the material making up the housing 50, enabling swinging movement of the side panel 42 relative to the pivot axis 45. Each side panel 42 is releasably secured in a fixed position along the body of the housing 39 by means of a locking arrangement. In the exemplary embodiment of FIG.

1, this locking arrangement includes a tab 43 extending from the side panel 42 for defining an aperture which engages with a respective boss 44 located adjacent each end block 35 on the body of the housing 50.

Housing 50 forms a support frame for receiving a replaceable conductive shield in a configuration adapted to partially enclose the corona generating electrode while exposing the corona generating electrode 30 to a surface to be charged. In accordance with the present invention, the shield includes a base shield member 34 and a pair of side shield members 40. Base shield element 34 is constructed in tubular fashion in such as way as to be slideably mounted in housing 50, situated opposite the open face thereof. The base shield element 34 is fastened into place when inserted within the housing 50 by means of a resilient spring retaining member 38 and can be removed form the housing by means of a handle 36. The base shield element 34 is connected to a power supply via sliding contact engagement with a leaf spring 37, which, in turn, is connected to a DC voltage source via a pin connector (not shown) when mounted in the electrostatographic printing machine.

Figure 3:
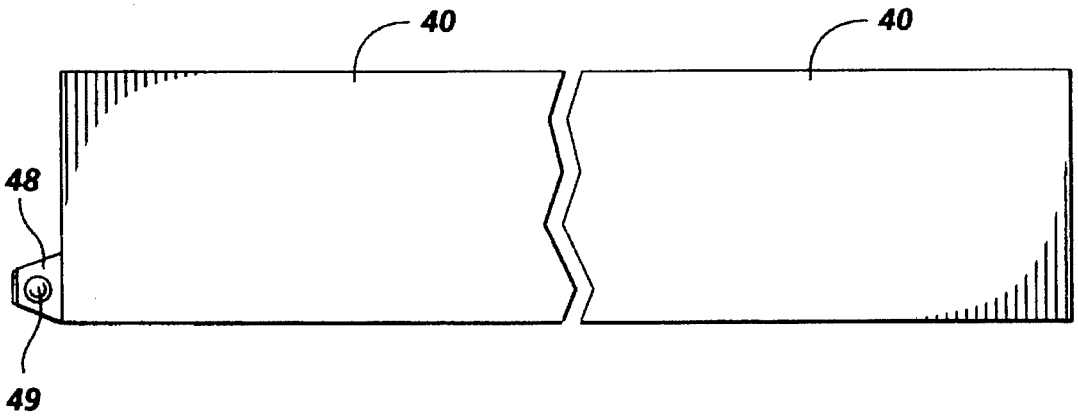
FIG. 3 is an elevational view of the preferred embodiment of a replaceable side shield member in accordance with the present invention.
Figure 4:
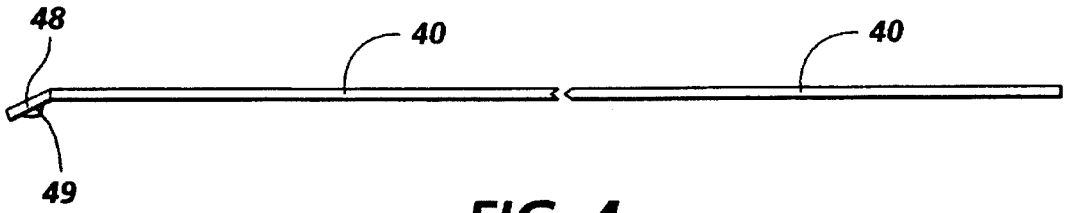
FIG. 4 is a plan view of the side shield member shown in FIG. 3.

Moving now to FIGS. 3 and 4, a preferred embodiment of a side shield element 40 in accordance with the corona generating device of the present invention is shown, wherein each side shield element 40 comprises a relatively thin strip. The side shield element 40 is fabricated from flat stock of a metal such as aluminum having a thickness of approximately 0.030 inches and a length substantially equal to the length of the corona generating electrode 30 located between anchors 31. The side shield element 40 includes a resilient tab 48 placed on an angled plane relative to the body of side shield element 40, having a conductive cap 49 protruding therefrom. Thus, when a side shield element 40 is properly mounted into the adjacent a side panel 42 of housing 49, the tab 48 will project in the direction of the base shield member 34 such that conductive cap 49 contacts the base shield member 34 to provide electrical continuity therebetween. In this manner, the side shield members 40 cooperate with the base shield member 34 to form a U-shaped conductive biasing shield, partially enclosing the corona generating electrode 30. It will be understood that both the base shield member 34 and the pair of secondary side shield members 40 may have a substantially continuous thin film overcoating containing a sufficient amount of reactive particles which will combine with corona effluents for neutralize the same when they are generated in the charging environment.

As described, side shield members 40 are formed of thin strips of conductive material for being mounted on the interior surface of each side panel 42. In order to facilitate mounting of the side shield members 40, each side panel 42 includes a pair of opposed lip elements 46 forming a channel for slidably receiving a respective edge portion of side shield member 40. The side shield members 40 are mounted in their appropriate positions by use of the pivoting feature previously described. That is, the side shield members can be inserted in the housing 50 by releasing the locking arrangement such that side panel 42 can be pivoted away from the body of the housing 39, thereby permitting access to the interior surface of the side panel 40. Thus, each side shield member 40 can easily be removed and replaced, or otherwise serviced in this manner. After the replacement or servicing process is completed the pivotable side panel 42 is snapped back into position by the locking action of each boss 44 engaging with respective aperture 43 located on side panels 42 (FIG. 1).

In recapitulation, it is evident that the corona generating device described herein includes a housing for receiving a replaceable shield comprising a base shield element and a pair of side shield elements, wherein each of the shield elements are mounted in the housing in a configuration so as to partially enclose a corona generating electrode. The housing is provided with pivotable side panels which each further include a pair of lip elements forming a channel for slidably receiving a respective side shield element. The side panels are pivoted about a pivot axis for facilitating the service and replacement of the side shield elements to thereby prolong the operational life of the corona generating device.

It is, therefore, evident that there has been provided, in accordance with the present invention, a corona generating device that fully satisfies the aims and advantages of the invention as hereinabove set forth. While the invention has been described in conjunction with a preferred embodiment thereof, it is evident that many alternatives, modifications, and variations may be apparent to those skilled in the art. Accordingly, the patent is intended to embrace all such alternatives, modifications, and variations as are within the broad scope and spirit of the appended claims.

I claim:

1. A corona generating device for depositing an electrostatic charge on a surface, comprising:

a housing;

an elongated electrode supported by said housing;

opposed side panels movably mounted on said housing, defining an open face in said housing for exposing said elongated electrode to the surface to be charged; and a removable conductive shield mounted on an interior surface of said housing.

2. The corona generating device of claim 1, further including means for pivotably mounting said opposed side panels on said housing to provide access to an interior surface thereof.

3. The corona generating device of claim 2, wherein said means for pivotably mounting includes hinge means.

4. The corona generating device of claim 3, wherein said hinge means includes a living hinge.

5. The corona generating device of claim 1, further including locking means for securing one of said opposed side panels in a fixed position on said housing.

6. The corona generating device of claim 5, wherein said locking means includes:

a boss; and a tab defining an aperture for receiving said boss, wherein said boss and said tab are cooperative to provide locking engagement between one of said opposed side panels and said housing.

7. The corona generating device of claim 1, wherein said conductive shield includes a side shield member for mounting on one of said side panels.

8. The corona generating device of claim 7, wherein at least one of said opposed side panels includes a lip element forming a channel for insertably receiving said side shield member so as to removably mount said side shield member on said at least one of said opposed side panels.

9. The corona generating device of claim 7, wherein said conductive shield further includes a base shield member for being slidably mounted in said housing opposite the open face thereof.

10. The corona generating device of claim 9, wherein said side shield member includes a conductive tab for providing electrical continuity between said side shield member and said base shield member.

11. An electrostatographic printing apparatus, including a corona generating device for depositing an electrostatic charge on a surface situated in close proximity thereto, comprising:

a housing;

an elongated electrode supported by said housing;

opposed side panels movably mounted on said housing, defining an open face in said housing for exposing said elongated electrode to the surface to be charged; and a removable conductive shield mounted on an interior surface of said housing.

12. The electrostatographic printing apparatus of claim 11, further including means for pivotably mounting said opposed side panels on said housing to provide access to an interior surface thereof.

13. The electrostatographic printing apparatus of claim 12, wherein said means for pivotably mounting includes hinge means.

14. The electrostatographic printing apparatus of claim 13, wherein said hinge means includes a living hinge.

15. The electrostatographic printing apparatus of claim 13, wherein said corona generating device further includes locking means for securing one of said opposed side panels in a fixed position on said housing.

16. The electrostatographic printing apparatus of claim 15, wherein said locking means includes:

a boss; and a tab defining an aperture, wherein said boss and said tab are cooperative to provide locking engagement between one of said opposed side panels and said housing.

17. The electrostatographic printing apparatus of claim 11, wherein said conductive shield includes a side shield member for mounting on one of said opposed side panels.

18. The electrostatographic printing apparatus of claim 17, wherein at least one of said opposed side panels includes a lip element forming a channel for insertably receiving said side shield member so as to removably mount said side shield member on said at least one of said opposed side panels.

19. The electrostatographic printing apparatus of claim 17, wherein said conductive shield further includes a base shield member for being slidably mounted in said housing opposite the open face thereof.

20. The electrostatographic printing apparatus of claim 19, wherein said side shield member includes a conductive tab for providing electrical continuity between said side shield member and said base shield member.

* * * * *